US010801768B2

(12) United States Patent
Junge et al.

(10) Patent No.: US 10,801,768 B2
(45) Date of Patent: Oct. 13, 2020

(54) ICE MAKING ASSEMBLIES FOR MAKING CLEAR ICE

(71) Applicant: Haier US Appliance Solutions, Inc., Wilmington, DE (US)

(72) Inventors: Brent Alden Junge, Evansville, IN (US); Justin Tyler Brown, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 92 days.

(21) Appl. No.: 16/055,244

(22) Filed: Aug. 6, 2018

(65) Prior Publication Data

US 2020/0041186 A1 Feb. 6, 2020

(51) Int. Cl.

| | |
|---|---|
| ***F25C 1/12*** | (2006.01) |
| ***F25C 1/045*** | (2018.01) |
| *F25C 1/22* | (2018.01) |

(52) U.S. Cl.

CPC ..... *F25C 1/12* (2013.01); *F25C 1/045* (2013.01); *F25C 1/22* (2013.01); *F25C 2400/14* (2013.01)

(58) Field of Classification Search

CPC .... F25C 1/12; F25C 1/045; F25C 1/22; F25C 2400/14

USPC ..... 62/347

See application file for complete search history.

(56) References Cited

U.S. PATENT DOCUMENTS

| | | | | | |
|---|---|---|---|---|---|
| 1,996,050 | A * | 3/1935 | Pownall | F25C 1/22 | 62/68 |
| 2,145,773 | A * | 1/1939 | Glenn | F25C 1/12 | 62/67 |
| 2,145,774 | A * | 1/1939 | Glenn | F25C 1/12 | 62/159 |
| 2,488,529 | A * | 11/1949 | Field | F25C 1/06 | 62/348 |
| 2,542,892 | A * | 2/1951 | Bayston | F25C 1/045 | 62/347 |
| 2,593,874 | A * | 4/1952 | Grandia | F25C 1/12 | 62/71 |
| 2,612,030 | A * | 9/1952 | Ploeger | F25C 1/045 | 62/352 |

(Continued)

FOREIGN PATENT DOCUMENTS

| | | | |
|---|---|---|---|
| JP | 2003262442 | A | 9/2003 |
| JP | 2015190707 | A | 11/2015 |
| JP | 6089974 | B2 | 3/2017 |

*Primary Examiner* — Ljiljana V. Ciric
*Assistant Examiner* — Kirstin U Oswald
(74) *Attorney, Agent, or Firm* — Dority & Manning, P.A.

(57) ABSTRACT

In one exemplary aspect of the present disclosure, an ice making assembly is provided for making clear ice. The ice making assembly may include a conductive ice mold, an insulation jacket, and a water dispenser. The conductive ice mold may define an upper portion of a mold cavity extending from a top end to a bottom end. The insulation jacket may extend downward from the conductive ice mold. The insulation jacket may define a lower portion of the mold cavity. The lower portion of the mold cavity may be a vertically open passage aligned with the upper portion of the mold cavity. The water dispenser may be positioned below the insulation jacket to direct an ice-building spray of water to the mold cavity through the vertically open passage of the insulation jacket.

18 Claims, 6 Drawing Sheets

(56) References Cited

U.S. PATENT DOCUMENTS 2,613,506 A * 10/1952 Cook ..... F25C 5/10 62/138
2,645,095 A * 7/1953 Ploeger ..... F25C 1/045 62/138
2,656,686 A * 10/1953 Bayston ..... F25C 1/045 62/138
2,677,249 A * 5/1954 Mason ..... F25C 1/045 62/344
2,722,110 A * 11/1955 Denzer ..... F25C 1/045 62/73
2,723,536 A * 11/1955 Mason ..... F25C 1/045 62/347
2,729,070 A * 1/1956 Ames ..... F25C 1/045 62/347
2,740,265 A * 4/1956 Bayston ..... F25C 1/045 62/138
2,743,588 A * 5/1956 Dreier ..... F25C 1/04 62/142
2,746,262 A * 5/1956 Gallo ..... F25C 1/12 62/138
2,747,375 A * 5/1956 Pichler ..... F25C 1/12 62/179
2,763,993 A * 9/1956 Bayston ..... F25C 1/045 62/138
2,791,103 A * 5/1957 Guild ..... F25C 1/12 62/137
2,805,557 A * 9/1957 Hilger ..... F25C 1/12 62/349
2,834,189 A * 5/1958 Jaeger ..... F25C 1/12 62/73
2,866,322 A * 12/1958 Glenn ..... F25D 11/022 62/137
2,892,323 A * 6/1959 Woodmark ..... F25C 1/045 62/347
2,978,882 A * 4/1961 Bollefer ..... F25C 1/045 62/347
2,995,905 A * 8/1961 Ayres ..... F25C 1/12 62/344
2,997,861 A * 8/1961 Kocher ..... F25C 1/12 62/347
2,999,371 A * 9/1961 MacLeod ..... F25C 1/06 62/347
3,003,335 A * 10/1961 Kattis ..... F25C 1/12 62/348
3,009,336 A * 11/1961 Bayston ..... F25C 1/045 62/344
3,045,438 A * 7/1962 Foster ..... F25C 1/12 62/65
3,045,439 A * 7/1962 Alt ..... F25C 1/12 62/66
3,045,443 A * 7/1962 McGrath ..... F25C 1/12 62/71
3,062,018 A * 11/1962 Baker ..... F25C 1/045 62/81
3,106,072 A * 10/1963 Glenn ..... F25C 1/12 62/126
3,164,972 A * 1/1965 Swanson ..... F25C 1/12 62/320
3,171,266 A * 3/1965 Weiss ..... F25C 1/12 62/347
3,171,267 A * 3/1965 Mitchell ..... F25C 1/12 62/352
3,220,214 A * 11/1965 Cornelius ..... F25C 1/045 62/347
3,230,736 A * 1/1966 Swanson ..... F25C 1/12 62/515
3,277,661 A * 10/1966 Dwyer ..... F25C 1/045 62/135
3,289,430 A * 12/1966 Dedricks ..... F25C 1/045 62/188
3,386,258 A * 6/1968 Zygiel ..... F25C 1/045 62/138
3,423,952 A * 1/1969 Pugh ..... F25C 1/12 62/138
4,008,740 A * 2/1977 Chermack ..... F25C 5/00 141/100
4,142,678 A * 3/1979 Bottum ..... F25B 29/003 237/2 B
4,363,220 A * 12/1982 Ripley ..... F25C 1/12 62/138
4,602,489 A * 7/1986 Hara ..... F25C 1/045 62/320
4,899,548 A * 2/1990 Dimijian ..... F25C 1/12 62/138
4,910,974 A * 3/1990 Hara ..... F25C 1/045 62/347
4,942,742 A * 7/1990 Burruel ..... F25C 1/04 249/119
4,970,877 A 11/1990 Dimijian
5,606,869 A * 3/1997 Joo ..... F25C 1/12 62/347
6,062,036 A * 5/2000 Hobelsberger ..... F25C 1/045 62/347
6,311,501 B1 * 11/2001 Allison ..... F25C 1/12 62/303
7,444,829 B2 * 11/2008 Mori ..... F25C 1/22 249/78
7,665,316 B2 * 2/2010 Ito ..... F25C 1/22 62/135
2004/0099004 A1 * 5/2004 Somura ..... F25C 1/22 62/347
2013/0186113 A1 * 7/2013 Chung ..... F25C 1/22 62/66
2014/0047859 A1 * 2/2014 Schwulst ..... F25C 5/08 62/340
2014/0165599 A1 * 6/2014 Boarman ..... F25C 1/10 62/3.3
2014/0165619 A1 * 6/2014 Culley ..... F25C 1/18 62/71
2014/0165620 A1 * 6/2014 Culley ..... F25C 1/18 62/71
2014/0260349 A1 * 9/2014 Erbs ..... F25C 1/12 62/74
2015/0114012 A1 * 4/2015 Jafa ..... F25C 1/04 62/66

* cited by examiner

ICE MAKING ASSEMBLIES FOR MAKING CLEAR ICE

FIELD OF THE INVENTION

The present subject matter relates generally to ice making appliances, and more particularly to appliances for making substantially clear ice.

BACKGROUND OF THE INVENTION

In domestic and commercial applications, ice is often formed as solid cubes, such as crescent cubes or generally rectangular blocks. The shape of such cubes is often dictated by the environment during a freezing process. For instance, an ice maker can receive liquid water, and such liquid water can freeze within the ice maker to form ice cubes. In particular, certain ice makers include a freezing mold that defines a plurality of cavities. The plurality of cavities can be filled with liquid water, and such liquid water can freeze within the plurality of cavities to form solid ice cubes. Typical solid cubes or blocks may be relatively small in order to accommodate a large number of uses, such as temporary cold storage and rapid cooling of liquids in a wide range of sizes.

Although the typical solid cubes or blocks may be useful in a variety of circumstances, there are certain conditions in which distinct or unique ice shapes may be desirable. As an example, it has been found that relatively large ice cubes or spheres (e.g., larger than two inches in diameter) will melt slower than typical ice sizes/shapes. Slow melting of ice may be especially desirable in certain liquors or cocktails. Moreover, such cubes or spheres may provide a unique or upscale impression for the user.

In recent years, various ice presses have come to market. For example, certain presses include metal press elements that define a profile to which a relatively large ice billet may be reshaped (e.g., in response to gravity or generated heat). Such systems reduce some of the dangers and user skill required when reshaping ice by hand. However, the time needed for the systems to melt an ice billet is generally contingent upon the size and shape of the initial ice billet. Moreover, the quality (e.g., clarity) of the final solid cube or block may be dependent on the quality of the initial ice billet.

In typical ice making appliances, such as those for forming large ice billets, impurities and gases may be trapped within the billet. For example, impurities and gases may collect near the outer regions of the ice billet due to their inability to escape and as a result of the freezing liquid to solid phase change of the ice cube surfaces. Separate from or in addition to the trapped impurities and gases, a dull or cloudy finish may form on the exterior surfaces of an ice billet (e.g., during rapid freezing of the ice cube). Generally, a cloudy or opaque ice billet is the resulting product of typical ice making appliances. In order to ensure that a shaped or final ice cube or sphere is substantially clear, many systems form solid ice billets that are substantially bigger (e.g., 50% larger in mass or volume) than a desired final ice cube or sphere. Along with being generally inefficient, this may significantly increase the amount of time and energy required to melt or shape an initial ice billet into a final cube or sphere. Furthermore, freezing such a large ice billet (e.g., larger than two inches in diameter or width) may risk cracking, for instance, if a significant temperature gradient develops across the ice billet.

Accordingly, further improvements in the field of ice making would be desirable. In particular, it may be desirable to provide an appliance or assembly for rapidly and reliably producing substantially clear ice billets while addressing one or more of the above identified issues.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, an ice making assembly is provided. The ice making assembly may include a conductive ice mold, an insulation jacket, a sealed refrigeration system, and a water dispenser. The conductive ice mold may define an upper portion of a mold cavity extending from a top end to a bottom end. The insulation jacket may extend downward from the conductive ice mold. The insulation jacket may define a lower portion of the mold cavity. The lower portion of the mold cavity may be a vertically open passage aligned with the upper portion of the mold cavity. The sealed refrigeration system may include an evaporator in conductive thermal communication with the conductive ice mold above the insulation jacket. The water dispenser may be positioned below the insulation jacket to direct an ice-building spray of water to the mold cavity through the vertically open passage of the insulation jacket.

In another exemplary aspect of the present disclosure, an ice making assembly is provided. The ice making assembly may include a conductive ice mold, an insulation jacket, a water dispenser, and a controller. The conductive ice mold may define an upper portion of a mold cavity extending from a top end to a bottom end. The insulation jacket may extend downward from the conductive ice mold. The insulation jacket may define a lower portion of the mold cavity. The lower portion of the mold cavity may be a vertically open passage aligned with the upper portion of the mold cavity. The water dispenser may be positioned below the insulation jacket to direct an ice-building spray of water to the mold cavity through the vertically open passage of the insulation jacket. The controller may be configured to alternately initiate the ice-building spray and a discrete ice-reducing to the mold cavity. The ice-reducing spray may be initiated subsequent to and separate from the ice-building spray.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
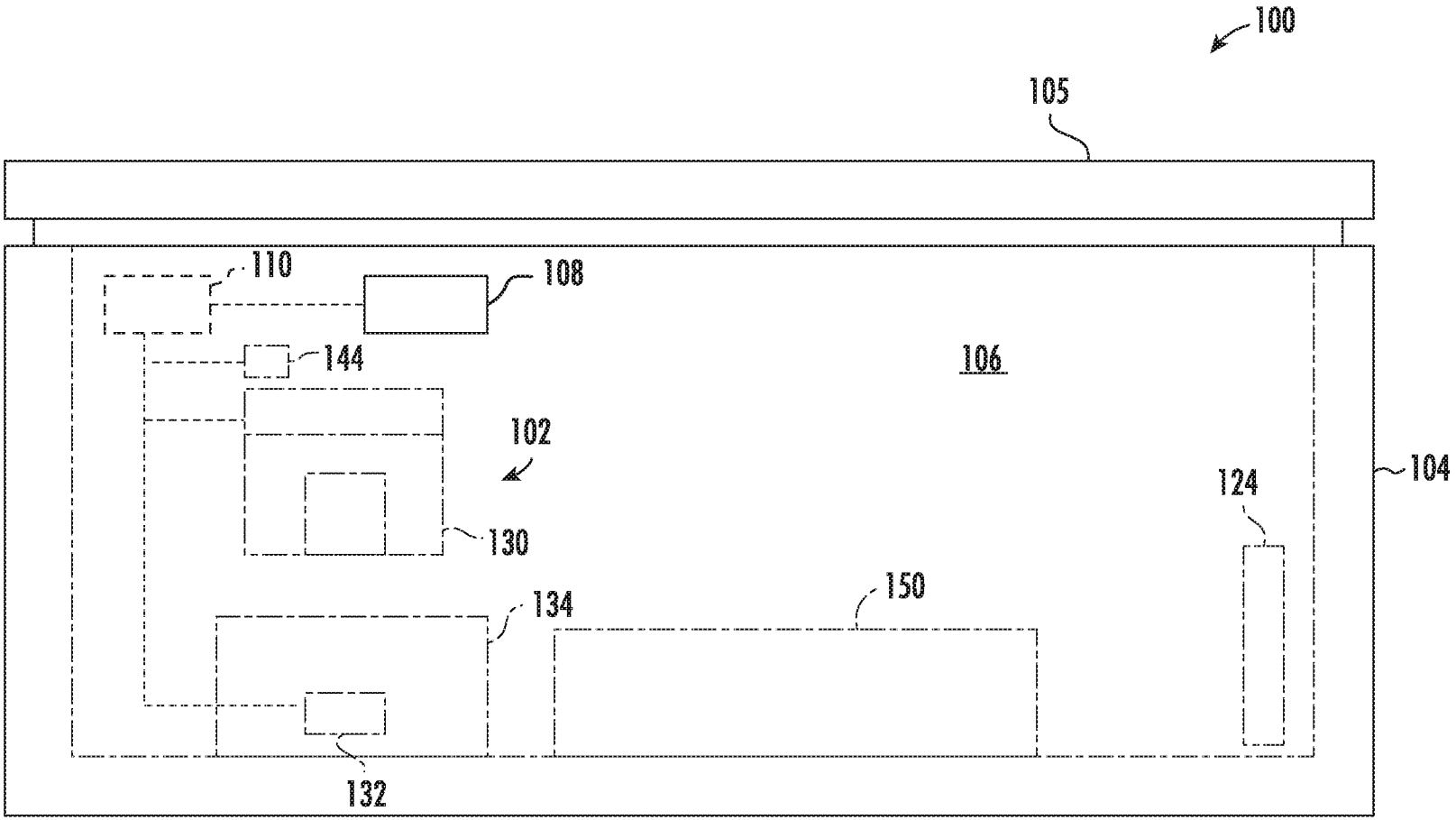
FIG. 1 provides a side plan view of an ice making appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows. The terms "includes" and "including" are intended to be inclusive in a manner similar to the term "comprising." Similarly, the term "or" is generally intended to be inclusive (i.e., "A or B" is intended to mean "A or B or both").

Figure 2:
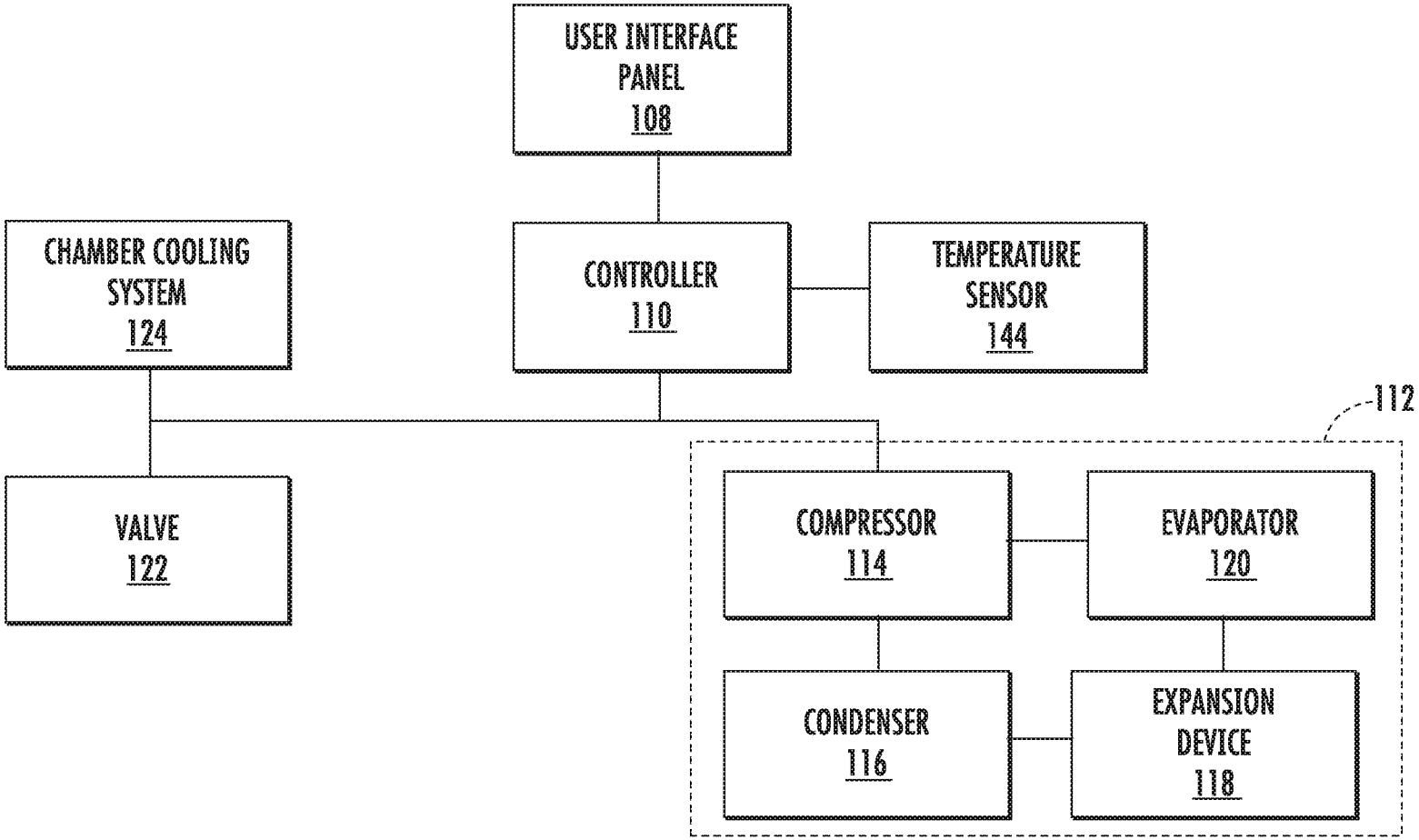
FIG. 2 provides a schematic view of an ice making assembly according to exemplary embodiments of the present disclosure.
Figure 3:
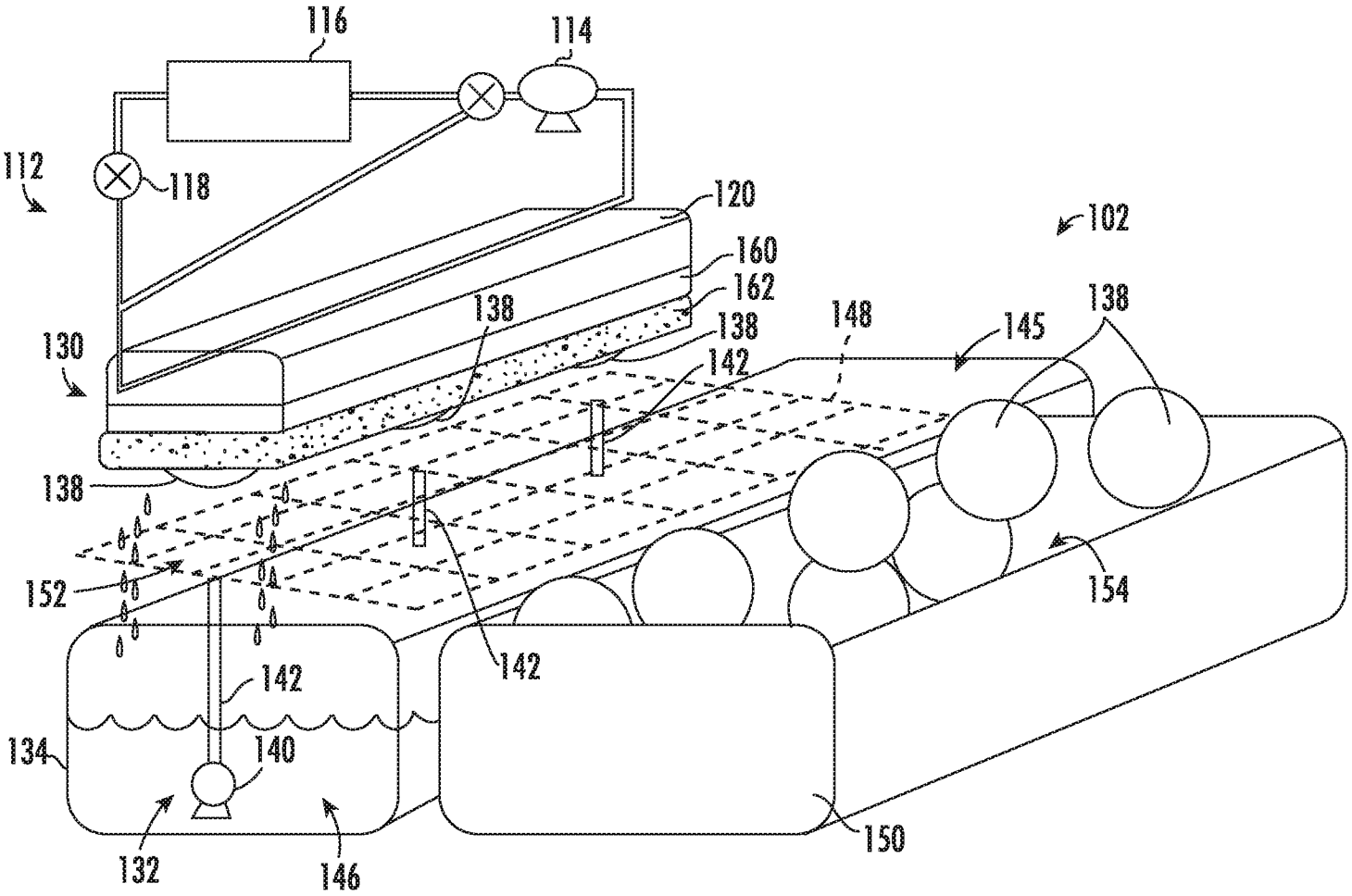
FIG. 3 provides a simplified perspective view of an ice making assembly according to exemplary embodiments of the present disclosure.

Turning now to the figures, FIG. 1 provides a side plan view of an ice making appliance 100, including an ice making assembly 102. FIG. 2 provides a schematic view of ice making assembly 102. FIG. 3 provides a simplified perspective view of ice making assembly 102.

Generally, ice making appliance 100 includes a cabinet 104 (e.g., insulated housing) and defines a mutually orthogonal vertical direction V, lateral direction, and transverse direction. The lateral direction and transverse direction may be generally understood to be horizontal directions H. As shown, cabinet 104 defines one or more chilled chambers, such as a freezer chamber 106. In certain embodiments, such as those illustrated by FIG. 1, ice making appliance 100 is understood to be formed as, or as part of, a stand-alone freezer appliance. It is recognized, however, that additional or alternative embodiments may be provided within the context of other refrigeration appliances. For instance, the benefits of the present disclosure may apply to any type or style of a refrigerator appliance (e.g., a top mount refrigerator appliance, a bottom mount refrigerator appliance, a side-by-side style refrigerator appliance, etc.) that includes a freezer chamber. Consequently, the description set forth herein is for illustrative purposes only and is not intended to be limiting in any aspect to any particular chamber configuration.

Ice making appliance 100 generally includes an ice making assembly 102 on or within freezer chamber 106. In some embodiments, ice making appliance 100 includes a door 105 that is rotatably attached to cabinet 104 (e.g., at a top portion thereof). As would be understood, door 105 may selectively cover an opening defined by cabinet 104. For instance, door 105 may rotate on cabinet 104 between an open position (not pictured) permitting access to freezer chamber 106 and a closed position (FIG. 2) restricting access to freezer chamber 106.

A user interface panel 108 is provided for controlling the mode of operation. For example, user interface panel 108 may include a plurality of user inputs (not labeled), such as a touchscreen or button interface, for selecting a desired mode of operation. Operation of ice making appliance 100 can be regulated by a controller 110 that is operatively coupled to user interface panel 108 or various other components, as will be described below. User interface panel 108 provides selections for user manipulation of the operation of ice making appliance 100 such as (e.g., selections regarding chamber temperature, ice making speed, or other various options). In response to user manipulation of user interface panel 108, or one or more sensor signals, controller 110 may operate various components of the ice making appliance 100 or ice making assembly 102.

Controller 110 may include a memory (e.g., non-transitive memory) and one or more microprocessors, CPUs or the like, such as general or special purpose microprocessors operable to execute programming instructions or micro-control code associated with operation of ice making appliance 100. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 110 may be constructed without using a microprocessor (e.g., using a combination of discrete analog or digital logic circuitry; such as switches, amplifiers, integrators, comparators, flip-flops, AND gates, and the like; to perform control functionality instead of relying upon software).

Controller 110 may be positioned in a variety of locations throughout ice making appliance 100. In optional embodiments, controller 110 is located within the user interface panel 108. In other embodiments, the controller 110 may be positioned at any suitable location within ice making appliance 100, such as for example within cabinet 104. Input/output ("I/O") signals may be routed between controller 110 and various operational components of ice making appliance 100. For example, user interface panel 108 may be in communication with controller 110 via one or more signal lines or shared communication busses.

As illustrated, controller 110 may be in communication with the various components of ice making assembly 102 and may control operation of the various components. For example, various valves, switches, etc. may be actuatable based on commands from the controller 110. As discussed, user interface panel 108 may additionally be in communication with the controller 110. Thus, the various operations may occur based on user input or automatically through controller 110 instruction.

Generally, ice making appliance 100 includes a sealed refrigeration system 112 for executing a vapor compression cycle for cooling water within ice making appliance 100

(e.g., within freezer chamber 106). Sealed refrigeration system 112 includes a compressor 114, a condenser 116, an expansion device 118, and an evaporator 120 connected in fluid series and charged with a refrigerant. As will be understood by those skilled in the art, sealed refrigeration system 112 may include additional components (e.g., one or more directional flow valves or an additional evaporator, compressor, expansion device, or condenser). Moreover, at least one component (e.g., evaporator 120) is provided in thermal communication (e.g., conductive thermal communication) with an ice mold or mold assembly 130 (FIG. 3) to cool mold assembly 130, such as during ice making operations. Optionally, evaporator 120 is mounted within freezer chamber 106, as generally illustrated in FIG. 1.

Within sealed refrigeration system 112, gaseous refrigerant flows into compressor 114, which operates to increase the pressure of the refrigerant. This compression of the refrigerant raises its temperature, which is lowered by passing the gaseous refrigerant through condenser 116. Within condenser 116, heat exchange with ambient air takes place so as to cool the refrigerant and cause the refrigerant to condense to a liquid state.

Expansion device 118 (e.g., a mechanical valve, capillary tube, electronic expansion valve, or other restriction device) receives liquid refrigerant from condenser 116. From expansion device 118, the liquid refrigerant enters evaporator 120. Upon exiting expansion device 118 and entering evaporator 120, the liquid refrigerant drops in pressure and vaporizes. Due to the pressure drop and phase change of the refrigerant, evaporator 120 is cool relative to freezer chamber 106. As such, cooled water and ice or air is produced and refrigerates ice making appliance 100 or freezer chamber 106. Thus, evaporator 120 is a heat exchanger which transfers heat from water or air in thermal communication with evaporator 120 to refrigerant flowing through evaporator 120.

Optionally, one or more directional valves may be provided (e.g., between compressor 114 and condenser 116) to selectively redirect refrigerant through a bypass line connecting the directional valve or valves to a point in the fluid circuit downstream from the expansion device 118 and upstream from the evaporator 120. In other words, the one or more directional valves may permit refrigerant to selectively bypass the condenser 116 and expansion device 120.

In additional or alternative embodiments, ice making appliance 100 further includes a valve 122 for regulating a flow of liquid water to ice making assembly 102. For example, valve 122 may be selectively adjustable between an open configuration and a closed configuration. In the open configuration, valve 122 permits a flow of liquid water to ice making assembly 102 (e.g., to a water dispenser 132 or a water basin 134 of ice making assembly 102). Conversely, in the closed configuration, valve 122 hinders the flow of liquid water to ice making assembly 102.

In certain embodiments, ice making appliance 100 also includes a discrete chamber cooling system 124 (e.g., separate from sealed refrigeration system 112) to generally draw heat from within freezer chamber 106. For example, discrete chamber cooling system 124 may include a corresponding sealed refrigeration circuit (e.g., including a unique compressor, condenser, evaporator, and expansion device) or air handler (e.g., axial fan, centrifugal fan, etc.) configured to motivate a flow of chilled air within freezer chamber 106.

In some embodiments, one or more sensors are mounted on or within ice mold 130. As an example, a temperature sensor 144 may be mounted adjacent to ice mold 130. Temperature sensor 144 may be electrically coupled to controller 110 and configured to detect the temperature within ice mold 130. Temperature sensor 144 may be formed as any suitable temperature detecting device, such as a thermocouple, thermistor, etc.

Figure 4:
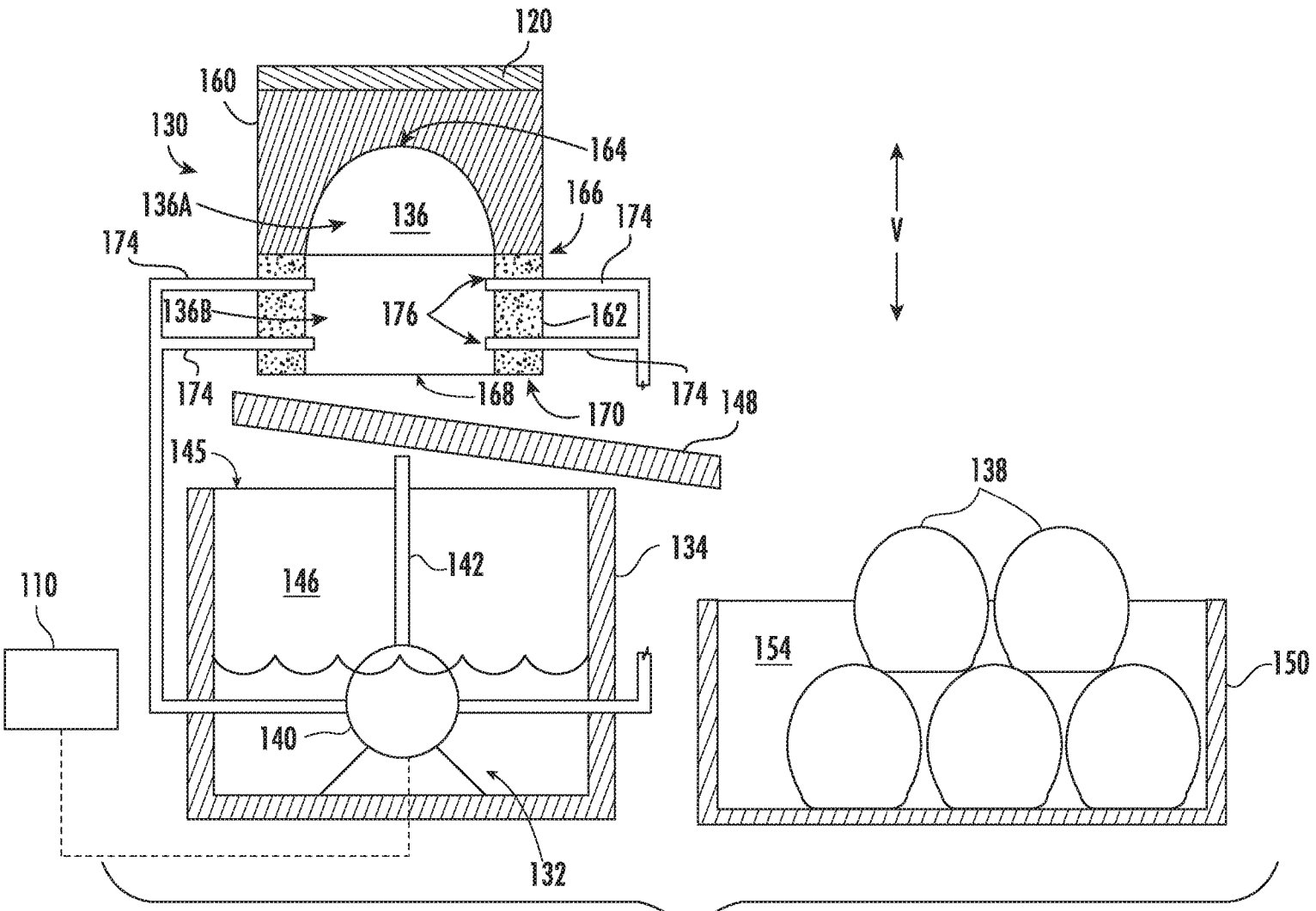
FIG. 4 provides a cross-sectional, schematic view of the exemplary ice making assembly of FIG. 3.

Turning now to FIGS. 3 and 4, FIG. 4 provides a cross-sectional, schematic view of ice making assembly 102. As shown, ice making assembly 102 includes a mold assembly 130 that defines a mold cavity 136 within which an ice billet 138 may be formed. Optionally, a plurality of mold cavities 136 may be defined by mold assembly 130 and spaced apart from each other (e.g., perpendicular to the vertical direction V). One or more portions of sealed refrigeration system 112 may be in thermal communication with mold assembly 130. In particular, evaporator 120 may be placed on or in contact (e.g., conductive contact) with a portion of mold assembly 130. During use, evaporator 120 may selectively draw heat from mold cavity 136, as will be further described below. Moreover, a water dispenser 132 positioned below mold assembly 130 may selectively direct the flow of water into mold cavity 136. Generally, water dispenser 132 includes a water pump 140 and at least one nozzle 142 directed (e.g., vertically) toward mold cavity 136. In embodiments wherein multiple discrete mold cavities 136 are defined by mold assembly 130, water dispenser 132 may include a plurality of nozzles 142 or fluid pumps vertically aligned with the plurality mold cavities 136. For instance, each mold cavity 136 may be vertically aligned with a discrete nozzle 142.

In some embodiments, a water basin 134 is positioned below the ice mold (e.g., directly beneath mold cavity 136 along the vertical direction V). Water basin 134 includes a solid nonpermeable body and may define a vertical opening 145 and interior volume 146 in fluid communication with mold cavity 136. When assembled, fluids, such as excess water falling from mold cavity 136, may pass into interior volume 146 of water basin 134 through vertical opening 145. In certain embodiments, one or more portions of water dispenser 132 are positioned within water basin 134 (e.g., within interior volume 146). As an example, water pump 140 may be mounted within water basin 134 in fluid communication with interior volume 146. Thus, water pump 140 may selectively draw water from interior volume 146 (e.g., to be dispensed by spray nozzle 142). Nozzle 142 may extend (e.g., vertically) from water pump 140 through interior volume 146.

In optional embodiments, a guide ramp 148 is positioned between mold assembly 130 and water basin 134 along the vertical direction V. For example, guide ramp 148 may include a ramp surface that extends at a negative angle (e.g., relative to a horizontal direction) from a location beneath mold cavity 136 to another location spaced apart from water basin 134 (e.g., horizontally). In some such embodiments, guide ramp 148 extends to or terminates above an ice bin 150. Additionally or alternatively, guide ramp 148 may define a perforated portion 152 that is, for example, vertically aligned between mold cavity 136 and nozzle 142 or between mold cavity 136 and interior volume 146. One or more apertures are generally defined through guide ramp 148 at perforated portion 152. Fluids, such as water, may thus generally pass through perforated portion 152 of guide ramp 148 (e.g., along the vertical direction between mold cavity 136 and interior volume 146).

As shown, ice bin 150 generally defines a storage volume 154 and may be positioned below mold assembly 130 and mold cavity 136. Ice billets 138 formed within mold cavity 136 may be expelled from mold assembly 130 and subsequently stored within storage volume 154 of ice bin 150 (e.g., within freezer chamber 106). In some such embodiments, ice bin 150 is positioned within freezer chamber 106 and horizontally spaced apart from water basin 134, water dispenser 132, or mold assembly 130. Guide ramp 148 may span the horizontal distance between mold assembly 130 and ice bin 150. As ice billets 138 descend or fall from mold cavity 136, the ice billets 138 may thus be motivated (e.g., by gravity) toward ice bin 150.

Figure 5:
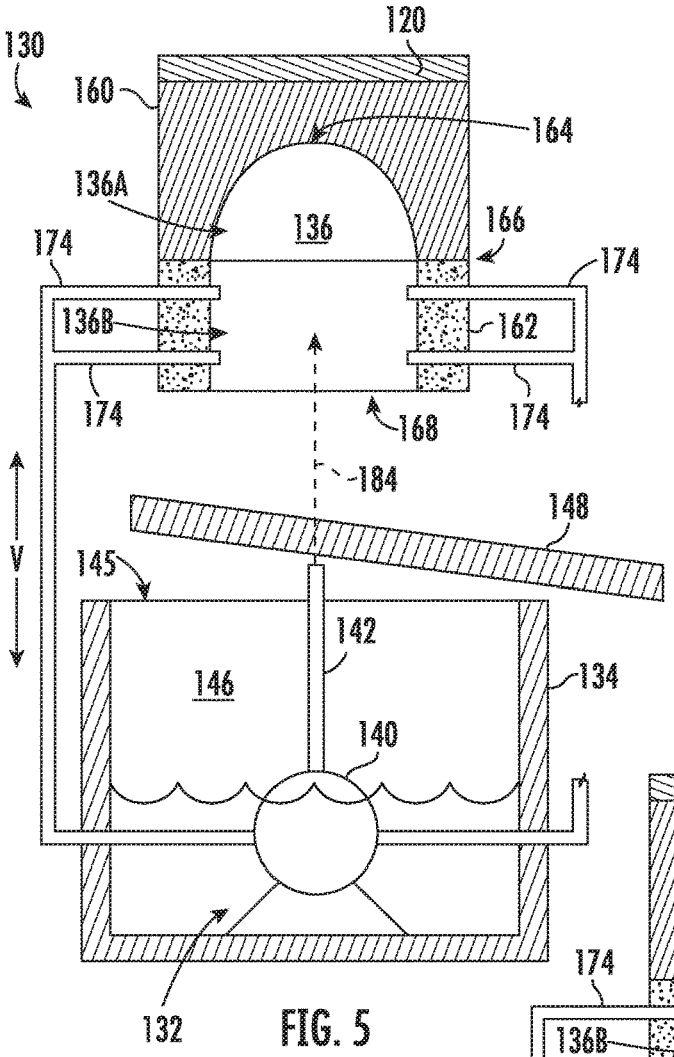
FIG. 5 provides a cross-sectional, schematic view of a portion of the exemplary ice making assembly of FIG. 3 during an ice forming operation.
Figure 6:
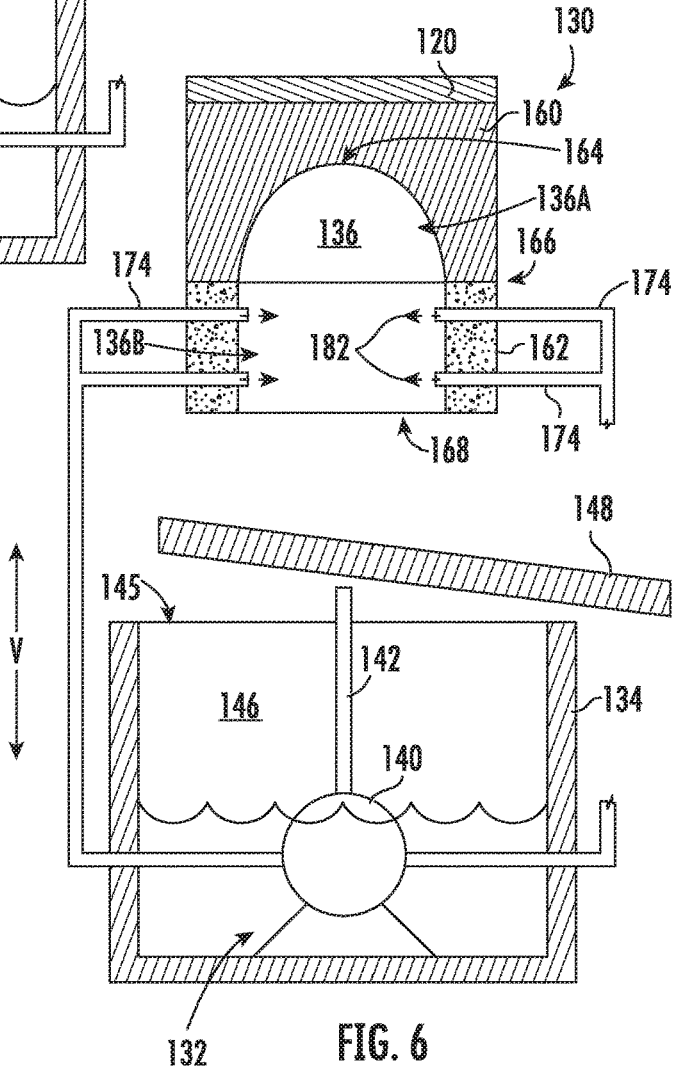
FIG. 6 provides a cross-sectional, schematic view of a portion of the exemplary ice making assembly of FIG. 3 during a release operation.

Turning now generally to FIGS. 4 through 6, FIGS. 5 and 6 illustrate portions of ice making assembly 102 during exemplary ice forming operations (FIG. 5) and releasing operations (FIG. 6). As shown, mold assembly 130 is formed from discrete conductive ice mold 160 and insulation jacket 162. Generally, insulation jacket 162 extends downward from (e.g., directly from) conductive ice mold 160. For instance, insulation jacket 162 may be fixed to conductive ice mold 160 through one or more suitable adhesives or attachment fasteners (e.g., bolts, latches, mated prongs-channels, etc.) positioned or formed between conductive ice mold 160 and insulation jacket 162.

Together, conductive ice mold 160 and insulation jacket 162 may define mold cavity 136. For instance, conductive ice mold 160 may define an upper portion 136A of mold cavity 136 while insulation jacket 162 defines a lower portion 136B of mold cavity 136. Upper portion 136A of mold cavity 136 may extend between a nonpermeable top end 164 and an open bottom end 166. Additionally or alternatively, upper portion 136A of mold cavity 136 may be curved (e.g., hemispherical) in open fluid communication with lower portion 136B of mold cavity 136. Lower portion 136B of mold cavity 136 may be a vertically open passage that is aligned (e.g., in the vertical direction V) with upper portion 136A of mold cavity 136. Thus, mold cavity 136 may extend along the vertical direction between a mold opening 168 at a bottom portion or bottom surface 170 of insulation jacket 162 to top end 164 within conductive ice mold 160. In some such embodiments, mold cavity 136 defines a constant diameter or horizontal width from lower portion 136B to upper portion 136A. When assembled, fluids, such as water may pass to upper portion 136A of mold cavity 136 through lower portion 136B of mold cavity 136 (e.g., after flowing through the bottom opening defined by insulation jacket 162).

Conductive ice mold 160 and insulation jacket 162 are formed, at least in part, from two different materials. Conductive ice mold 160 is generally formed from a thermally conductive material (e.g., metal, such as aluminum or stainless steel, including alloys thereof) while insulation jacket 162 is generally formed from a thermally insulating material (e.g., insulating polymer, such as a synthetic silicone configured for use within subfreezing temperatures without significant deterioration). In some embodiments, conductive ice mold 160 is formed from material having a greater amount of water surface adhesion than the material from which insulation jacket 162 is formed. Water freezing within mold cavity 136 may be prevented from extending horizontally along bottom surface 170 of insulation jacket 162.

Advantageously, an ice billet within mold cavity 136 may be prevented from mushrooming beyond the bounds of mold cavity 136. Moreover, if multiple mold cavities 136 are defined within mold assembly 130, ice making assembly 102 may advantageously prevent a connecting layer of ice from being formed along the bottom surface 170 of insulation jacket 162 between the separate mold cavities 136 (and ice billets therein). Further advantageously, the present embodiments may ensure an even heat distribution across an ice billet within mold cavity 136. Cracking of the ice billet or formation of a concave dimple at the bottom of the ice billet may thus be prevented.

In some embodiments, the unique materials of conductive ice mold 160 and insulation jacket 162 each extend to the surfaces defining upper portion 136A and lower portion 136B of mold cavity 136. In particular, a material having a relatively high water adhesion may define the bounds of upper portion 136A of mold cavity 136 while a material having a relatively low water adhesion defines the bounds of lower portion 136B of mold cavity 136. For instance, the surface of insulation jacket 162 defining the bounds of lower portion 136B of mold cavity 136 may be formed from an insulating polymer (e.g., silicone). The surface of conductive mold cavity 136 defining the bounds of upper portion 136A of mold cavity 136 may be formed from a thermally conductive metal (e.g. aluminum). In some such embodiments, the thermally conductive metal of conductive ice mold 160 may extend along (e.g., the entirety of) of upper portion 136A.

Figure 7:
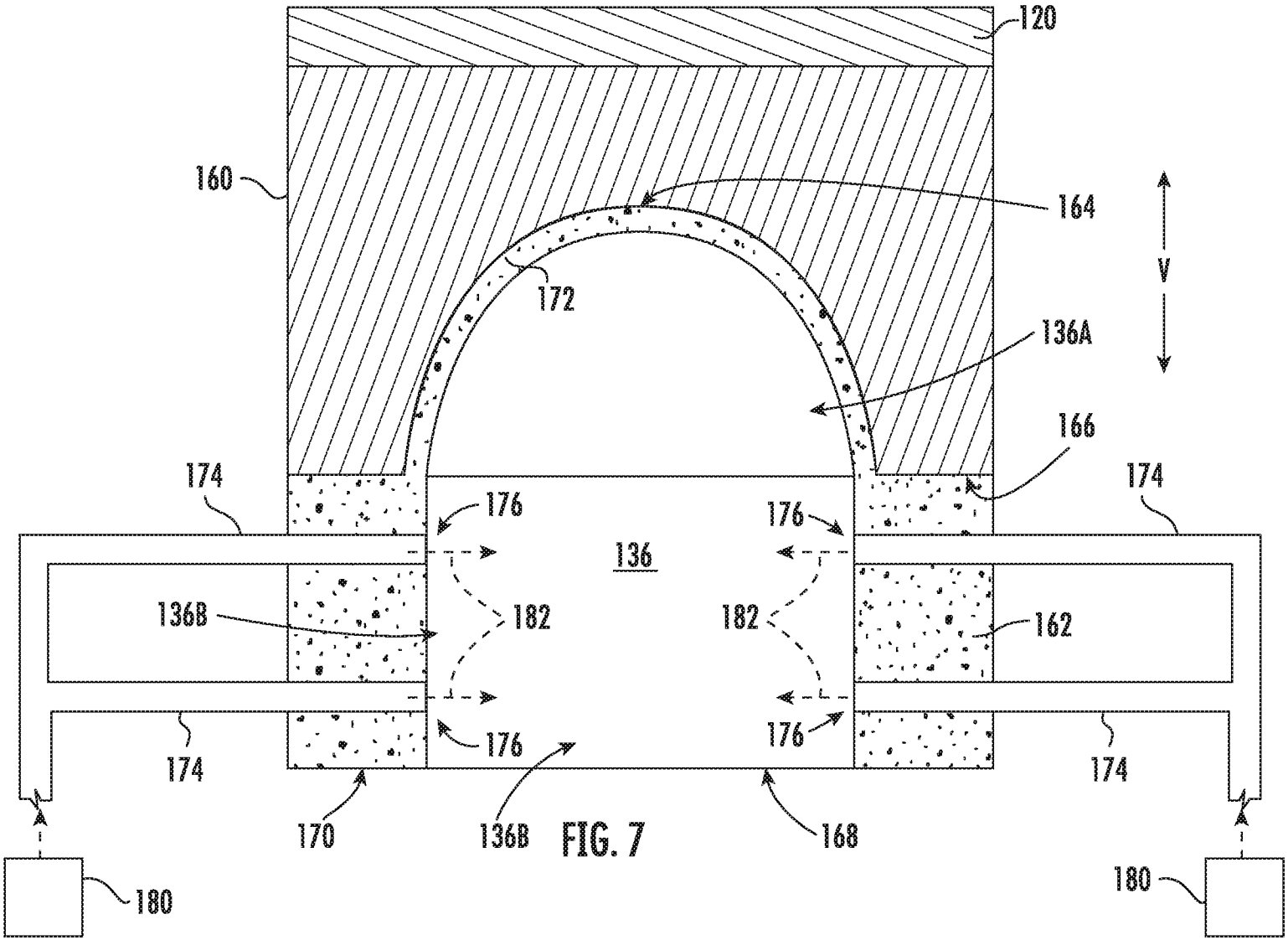
FIG. 7 provides a cross-sectional, schematic view of a mold assembly of an ice making assembly according to exemplary embodiments of the present disclosure.

Turning briefly to FIG. 7, in alternative embodiments, the material or materials defining the bounds of upper portion 136A of mold cavity 136 and lower portion 136B of mold cavity 136 may both have a relatively low water adhesion. For instance, an insulation film 172 may extend along and define the bounds of upper portion 136A of mold cavity 136. In other words, insulation film 172 may extend along an inner surface of conductive ice mold 160 at upper portion 136A of mold cavity 136. In some such embodiments, insulation film 172 extends from insulation jacket 162 (e.g., as a unitary or monolithic integral unit with insulation jacket 162). Optionally, the material which forms insulation film 172 may be the same as the material that defines the bounds of lower portion 136B of mold cavity 136.

Turning now generally to FIGS. 4 through 7, in some embodiments, a plurality of fluid channels 174 are defined through insulation jacket 162. In particular, the plurality of fluid channels 174 may extend through insulation jacket 162 to lower portion 136B of mold cavity 136. Thus, each fluid channel 174 may define an outlet 176 above mold opening 168. In some such embodiments, one or more of fluid channels 174 may extend at an angle that is nonparallel to the vertical direction V. For instance, channels may be perpendicular to the vertical direction V.

Generally, fluid channels 174 may be in fluid communication with one or more fluid pumps and fluid sources to direct a fluid therefrom as an ice-reducing spray (e.g., as indicated at arrows 182). In certain embodiments, one or more of fluid channels 174 are in fluid communication with a water pump (e.g., water pump 140 within water basin 134). Water pump 140 may be configured to direct a water flow to lower portion 136B of mold cavity 136. At least a portion of the ice-reducing spray 182 may thus be a water spray to partially melt an ice billet within mold cavity 136 and encourage an ice billet to release from mold cavity 136. In additional or alternative embodiments, one or more of fluid channels 174 in fluid communication with an air pump 180 (e.g., in fluid communication with a compressed or ambient air source). The air pump 180 may be configured to direct an airflow to lower portion 136B of mold cavity 136. At least a portion of the ice-reducing spray 182 may thus be an air spray to partially melt and ice billet within mold cavity 136 and encourage an ice billet to release from mold cavity 136.

As shown, controller 110 may be in communication (e.g., electrical communication) with one or more portions of ice making assembly 102. In some embodiments, controller 110 is in communication with one or more fluid pumps (e.g., water pump 140 or air pump 180). Controller 110 may be configured to initiate discrete ice making operations and ice release operations. For instance, controller 110 may alternate the fluid source spray to mold cavity 136.

During ice making operations, controller 110 may initiate or direct water dispenser 132 to motivate an ice-building spray (e.g., as indicated at arrows 184) through nozzle 142 and into mold cavity 136 (e.g., through mold opening 168). Controller 110 may further direct sealed refrigeration system 112 (e.g., at compressor 114) (FIG. 3) to motivate refrigerant through evaporator 120 and draw heat from within mold cavity 136. As the water from the ice-building spray 184 strikes mold assembly 130 within mold cavity 136, a portion of the water may freeze in progressive layers from top end 164 to bottom end 166. Excess water (e.g., water within mold cavity 136 that does not freeze upon contact with mold assembly 130 or the frozen volume herein) and impurities within the ice-building spray 184 may fall from mold cavity 136 and, for example, to water basin 134.

Once an ice billet is formed within mold cavity 136, controller 110 may direct an ice release operation. During release operations, controller 110 may halt or prevent the ice-building spray 184 and initiate a discrete ice-reducing spray 182 to mold cavity 136. In other words, the ice-reducing spray 182 may be subsequent to and separate from the ice-building spray 184. Optionally, controller 110 may restrict or halt operation of sealed refrigeration system 112 (e.g., at compressor 114) (FIG. 3) during release operations. In certain embodiments, the ice-reducing spray 182 flows from plurality of fluid channels 174. For instance, the ice-reducing spray 182 may be formed from a flow of water or air motivated from a fluid pump (e.g., water pump 140 or air pump 180), as described above. Alternatively, the ice-reducing spray 182 may be formed from a flow of water motivated from water dispenser 132. In some such embodiments, nozzle 142 is configured to vary or alternate a spray pattern of water therefrom. Thus, the spray pattern from nozzle 142 at the ice-building spray 184 may be unique and distinct from the spray pattern from nozzle 142 at the ice-reducing spray 182.

The ice-reducing spray 182 may be motivated by and from the same pump or a separate pump as the fluid pump which motivates the ice-building spray 184. As the ice-reducing spray 182 flows to a portion of an ice billet within mold cavity 136, the ice billet may separate from mold assembly 130 and fall from mold cavity 136 through mold opening 168 (e.g., as motivated by gravity).

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice making assembly comprising:

a conductive ice mold defining an upper portion of a mold cavity extending from a top end to a bottom end;

an insulation jacket extending downward from the conductive ice mold, the insulation jacket defining a lower portion of the mold cavity, the lower portion of the mold cavity being a vertically open passage aligned with the upper portion of the mold cavity;

a sealed refrigeration system comprising an evaporator in conductive thermal communication with the conductive ice mold above the insulation jacket;

a water dispenser positioned below the insulation jacket to direct an ice-building spray of water to the mold cavity through the vertically open passage of the insulation jacket, a plurality of fluid channels in fluid communication with a fluid pump to direct an ice-reducing spray of fluid into the lower portion of the mold cavity above the mold opening and nonparallel to the vertical direction, and, wherein the plurality of fluid channels are defined through the insulation jacket, such that each fluid channel of the plurality of fluid channels has a longitudinal axis which is nonparallel to the vertical direction.

2. The ice making assembly of claim 1, further comprising a water basin positioned below the conductive ice mold to receive excess water from the ice-building spray.

3. The ice making assembly of claim 1, further comprising an ice bin positioned below the conductive ice mold to receive ice therefrom.

4. The ice making assembly of claim 1, wherein the insulation jacket comprises an insulating polymer defining the lower portion of the mold cavity.

5. The ice making assembly of claim 1, wherein the conductive ice mold comprises aluminum extending along the upper portion of the mold cavity.

6. The ice making assembly of claim 1, further comprising an insulation film extending from the insulation jacket along an inner surface of the conductive ice mold at the upper portion of the mold cavity.

7. The ice making assembly of claim 1, wherein the fluid pump is an air pump configured to direct an air flow to the lower portion of the mold cavity.

8. The ice making assembly of claim 1, wherein the fluid pump is a water pump configured to direct a water flow to the lower portion of the mold cavity.

9. The ice making assembly of claim 8, further comprising a controller configured to alternately direct water to the water dispenser and the plurality of fluid channels.

10. The ice making assembly of claim 1, further comprising a controller configured to alternately initiate the ice-building spray and a discrete ice-reducing spray to the mold cavity, wherein the ice-reducing spray is initiated subsequent to and separate from the ice-building spray.

11. An ice making assembly comprising:

a conductive ice mold defining an upper portion of a mold cavity extending from a top end to a bottom end;

an insulation jacket extending downward from the conductive ice mold, the insulation jacket defining a lower portion of the mold cavity, the lower portion of the mold cavity being a vertically open passage aligned with the upper portion of the mold cavity;

a water dispenser positioned below the insulation jacket to direct an ice-building spray of water to the mold cavity through the vertically open passage of the insulation jacket;

a controller configured to alternately initiate the ice-building spray and a discrete ice-reducing to the mold cavity, wherein the ice-reducing spray is initiated subsequent to and separate from the ice-building spray, a plurality of fluid channels in fluid communication with a fluid pump to direct an ice-reducing spray of fluid into the lower portion of the mold cavity above the mold opening and nonparallel to the vertical direction, and, wherein the plurality of fluid channels are defined through the insulation jacket, such that each fluid channel of the plurality of fluid channels has a longitudinal axis which is nonparallel to the vertical direction.

12. The ice making assembly of claim 11, further comprising a water basin positioned below the conductive ice mold to receive excess water from the ice-building spray.

13. The ice making assembly of claim 11, further comprising an ice bin positioned below the conductive ice mold to receive ice therefrom.

14. The ice making assembly of claim 11, wherein the insulation jacket comprises an insulating polymer defining the lower portion of the mold cavity.

15. The ice making assembly of claim 11, wherein the conductive ice mold comprises aluminum extending along the upper portion of the mold cavity.

16. The ice making assembly of claim 11, further comprising an insulation film extending from the insulation jacket along an inner surface of the conductive ice mold at the upper portion of the mold cavity.

17. The ice making assembly of claim 11, wherein the fluid pump is an air pump configured to direct an air flow to the lower portion of the mold cavity.

18. The ice making assembly of claim 11, wherein the fluid pump is a water pump configured to direct a water flow to the lower portion of the mold cavity.

* * * * *